United States Patent [19]

Cuppett

[11] 4,399,720

[45] Aug. 23, 1983

[54] CORK PULLER

[75] Inventor: Darrell J. Cuppett, New York, N.Y.

[73] Assignee: Towle Manufacturing Company, Boston, Mass.

[21] Appl. No.: 379,252

[22] Filed: May 17, 1982

[51] Int. Cl.[3] ..... B67B 7/32

[52] U.S. Cl. ..... 81/3.37; 29/434; 74/422

[58] Field of Search ..... 81/3.37, 3.1 A; 74/422, 74/524, 534, 536, 535; 403/157, 159, 163; 254/12, 95; 29/434, 453

[56] References Cited

U.S. PATENT DOCUMENTS

| | | | |
|---|---|---|---|
| 1,753,026 | 4/1930 | Rosati | 81/3.37 |
| 2,115,289 | 4/1938 | Smith | 81/3.37 |
| 4,063,473 | 12/1977 | Bozzo | 81/3.37 |
| 4,097,980 | 7/1978 | Bozzo | 29/434 |
| 4,184,245 | 1/1980 | Mattingly, Jr. | 29/453 |

*Primary Examiner*—Roscoe V. Parker
*Attorney, Agent, or Firm*—Donald Brown

[57] ABSTRACT

A cork puller of the kind wherein a puller shaft is supported in a sleeve for vertical movement by means of pivotally mounted levers provided with toothed sectors which mesh with rack teeth on the puller shaft and, more particularly, to a bearing structure for supporting the levers which enables easy assembly of the levers with their toothed sectors in engagement with the rack teeth of the puller without the aid of rivets or screws visible from the outside and without having to distort the lever-supporting structure.

7 Claims, 7 Drawing Figures

CORK PULLER

BACKGROUND OF INVENTION

U.S. Pat. Nos. 4,063,473 and 4,097,980 show an improved cork puller wherein the lever arms are received and pivot about one or more ribs formed on the inner surfaces of opposed pairs of support ears, which results in no visible sign of a pivot support on the outer surfaces of the support ears. The lever arms are assembled by forcing them into place between the supporting ears, requiring that the ears be structured to enable distortion to the extent to receive the levers. U.S. Pat. Nos. 1,753,026 Rosati and 2,115,289 Smith disclose cork extractors wherein the lever arms are pivotally supported between support ears by means of visible rivets.

It is the purpose of this invention to provide a cork puller which not only has the advantages achieved over Rosati and Smith by providing bearing structure for the lever arms which is not visible from the outer surface of the supporting ears, but, in addition, embodies the improvement that the levers can be assembled without distortion of the supporting ears and, hence, without requiring special structural configuration to enable deflecting the ears sufficiently to receive the levers.

SUMMARY OF INVENTION

As herein illustrated, the cork puller of this invention comprises a structure having a bottom part of annular configuration adapted to rest on the top rim of a corked bottle and a top part comprising a sleeve for receiving a puller, to the lower end of which is fixed a worm, spaced, parallel bearing supports at equal radial distances from the axis of the sleeve and extending laterally from opposite sides of the axis of the sleeve, means at the upper end of the puller for effecting its rotation and means for raising and lowering the puller relative to the bottom part comprising rack teeth at opposite sides of the puller and levers provided with toothed sectors pivotally mounted on the bearing supports with their teeth in engagement with the rack teeth, the improvement residing in that one half of the sleeve taken on a diameter midway between the bearing supports and the bearing support integral therewith is integral with the bottom part and the other half and bearing support integral therewith is not and there are interengageable means confined exclusively to the confronting sides of the bearing supports which join the sleeve halves with the bearing supports in spaced, parallel relation and which define bearings for rotatably receiving the levers. The interengageable means comprise pins projecting from the confronting face of one of the bearing supports and bosses of circular cross section containing holes for receiving the pins projecting from the confronting face of the other of the bearing supports. The pins and bosses are dimensioned to be force-fitted into engagement and, when fully interengaged, to hold the bearing supports at a spacing to receive the levers therein for rotation.

The invention will now be described in greater detail with reference to the accompanying drawings, wherein.

Figure 1:
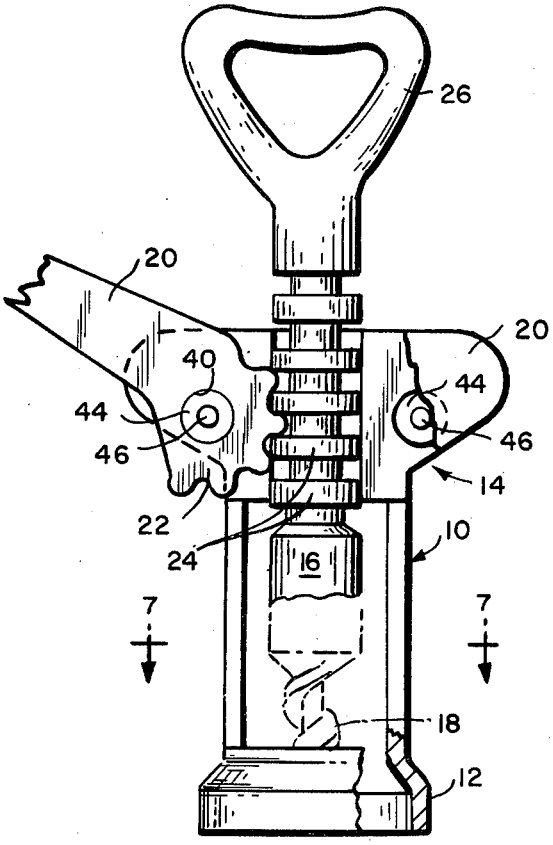
FIG. 1 is an elevation partly in section of the cork puller constructed according to this invention.
Figure 6:
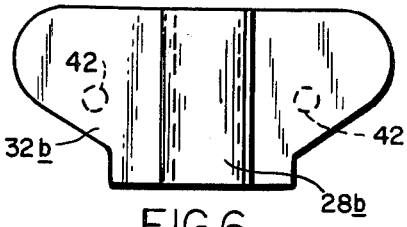
FIG. 6 is an elevation of the separated bearing support.
Figure 2:
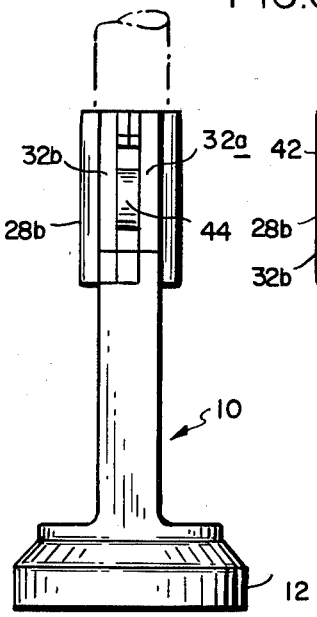
FIG. 2 is an elevation of the cork puller taken from the right side of FIG. 1 showing the bearing supports for the lever arms with the lever arm at the near side omitted and with the puller shaft and key omitted.
Figure 3:
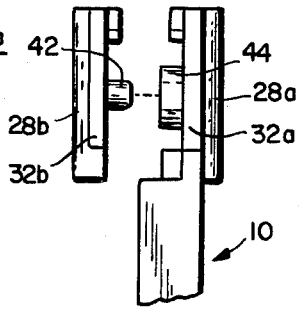
FIG. 3 is an elevation of the upper part of a cork puller with the bearing supports separated.
Figure 4:
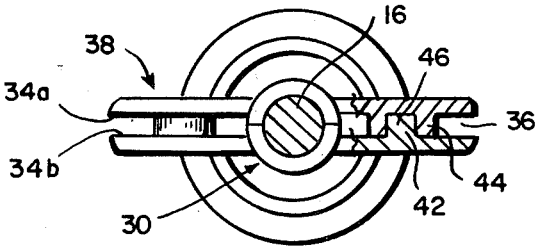
FIG. 4 is a view taken on the line 4—4 of FIG. 1 with parts in section.
Figure 5:
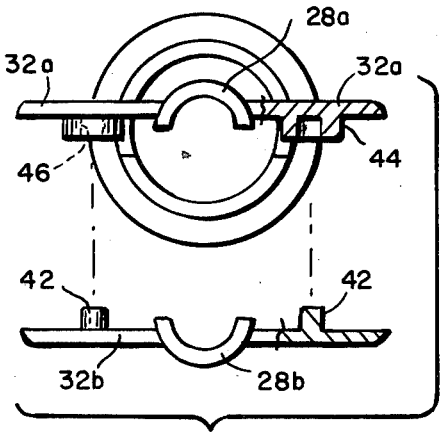
FIG. 5 is a plan view of FIG. 3 showing the bearing supports separated.
Figure 7:
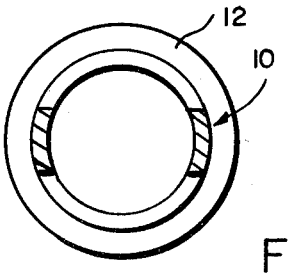
FIG. 7 is a section taken on the line 7—7 of FIG. 1.

Referring to the drawings, FIG. 1, the cork puller comprises a frame 10 having an annular bottom part 12 adapted to rest on the top rim of a corked bottle neck, a top part 14 constructed to support a puller shaft 16 in axial alignment with the bottom part, to the lower end of which is fixed a worm 18 and levers 20—20 provided with toothed sectors 22—22 which mesh with rack teeth 24 on the shaft 16. The levers 20—20 provide for elevating and lowering the shaft 16 and, hence, the work 18 and a key 26 fixed to the upper end of the puller shaft provides for rotating the shaft to insert the worm into the cork. The key may optionally be a cap opener. In accordance with this invention, the top part 14 is comprised of two half cylindrical portions **28*a*,28*b* which collectively define, when held engaged, a sleeve bearing 30 within which the puller shaft 16 is vertically reciprocal. Each half cylindrical part 28*a*,28*b* has laterally-extending bearing supports 32*a*—32*a* and 32*b*—32*b* in the form of ears offset from the axis of the sleeve so as to be in spaced, parallel relation to each other at opposite sides of the axis of the sleeve, as shown in FIG. 4, such that their inner or confronting surfaces 34*a* and 34*b* define an opening 36 between the supports for receiving the toothed sections of the levers 20—20**.

In further accordance with the invention, the confronting surface **34*a* of the bearing support 32*a* is provided with bearings 38—38 located symmetrically with respect to the axis of the sleeve, the external surfaces of which are of circular cross section so as to rotatably receive circular openings 40 adjacent the toothed sections of the levers 20 and to hold the latter with the teeth at their ends in mesh with the rack teeth 24 on the puller shaft 16**.

The bearings 38—38 comprise pins 42—42 formed integral with the confronting surface **34*b* of the bearing support 32*b* and bosses 44—44 formed integral with the confronting surface 34*a* of the bearing support 32*a* containing holes 46—46 for receiving the pins 42—42. The holes 46—46 in the bosses 44—44 and the pins 42—42** are so dimensioned that a press fit is required to engage them and, when so engaged, to hold the parts inseparable under any conditions of ordinary use of the implement. Further, the axial length of the bosses and pins is such that they function as spaces which hold the bearing supports at a spacing to receive the levers with a clearance for free, but not sloppy, rotation on the bearings.

In accordance with the invention, the sleeve half **28*a* and the bearing support 32*a* integral therewith is formed as an integral part of the frame 10, whereas the sleeve half 28*b* and the bearing support 32*b* integral therewith is formed as a separate part. The parts may be die-cast. As thus constructed, the levers 20—20 can be easily assembled with their toothed portions 22—22 engaged with the rack teeth 24—24 of the puller shaft by mounting them on bosses 44—44 and then placing the half-circular sleeve portion 28*b* and the bearing support 32*b* in a position with respect to the half-circular sleeve portion 28*a* and bearing support 32*a* such that the pins 42—42 are aligned with the holes 46—46 and pressing the pins into the holes. The result is a structure wherein the bearings 38—38** for the levers are concealed, that is, not visible from the exterior side of the structure, thus availing of the improved structure of the aforesaid patents and, in addition, a structure wherein the levers can be easily mounted without requiring that the bearing supports be structured with tapered surfaces to enable forcibly separating the bearing supports to admit the levers into their respective positions and thereafter bending the bearing supports together. Thus, the disadvantages of special die-casting procedures and assembling procedures involved in the prior-art cork pullers is avoided with a saving in cost of manufacture and assembly.

It should be understood that the present disclosure is for the purpose of illustration only and includes all modifications or improvements which fall within the scope of the appended claims.

What is claimed is:

1. A cork puller comprising a structure having a bottom part of annular configuration adapted to rest on the top rim of the corked bottle and a top part comprising a sleeve, spaced, parallel bearing supports at equal radial distances from the axis of the sleeve and extending laterally from opposite sides of the axis of the sleeve, said bearing supports being integral with the sleeve, a puller reciprocally and rotatably mounted in the sleeve, a worm fixed to the lower end of the puller, means at the upper end of the puller for effecting its rotation, and means for raising and lowering the puller relative to the bottom part comprising racks at opposite sides of the puller and levers, provided with teeth, pivotally mounted on the bearing supports with their teeth engaged with the racks, the improvement comprising that one half of the sleeve taken on a diameter midway between the bearing supports and the bearing support integral therewith is integral with the bottom part and the other half and bearing support integral therewith is not and there are interengaged means on the confronting sides of the bearing supports confined exclusively to the confronting sides which define bearings for rotatably receiving the levers.

2. A cork puller according to claim 1 wherein the interengageable means comprise pins projecting from the confronting face of one of the bearing supports and bosses containing holes for receiving the pins projecting from the confronting face of the other of the bearing supports.

3. A cork puller according to claim 1 wherein the bosses are of circular cross section and define cylindrical bearing surfaces upon which the levers are pivotally mounted.

4. A cork puller according to claim 2 wherein the pins and bosses are force-fitted into engagement.

5. A cork puller according to claim 2 wherein the length of the bosses and pins perpendicular to the confronting surfaces of the bearing supports constitute spacers which hold the bearing supports at a spacing corresponding substantially to the thickness of the levers with a clearance to permit free rotation thereof.

6. A cork puller according to claim 1 wherein the means at the upper end of the puller is a key.

7. The method of making a cork puller of the kind comprising a bottom part of annular configuration adapted to rest on the top rim of a corked bottle and a top part comprising a sleeve, spaced, parallel bearing supports at equal radial distances from the axis of the sleeve and extending laterally from the opposite sides of the axis of the sleeve, said bearing supports being integral with the sleeve, a puller reciprocally mounted in the sleeve, a worm fixed to the lower end of the puller, means at the upper end of the puller for effecting its rotation, and means for raising and lowering the puller relative to the bottom part comprising racks at opposite sides of the puller and levers provided with teeth pivotally mounted on the bearing supports with their teeth engaged with the racks comprising die-casting the lower part and one-half of the upper part comprising one-half of the sleeve and the integral bearing support as a unitary part, die-casting the other half of the upper part comprising the other half of the sleeve and integral bearing support as a separable part and, when die-casting the separate parts, die-casting bosses containing holes on the confronting surface of one of the bearing supports and pins on the confronting surface of the other bearing support, mounting the levers on the bosses, aligning the bearing supports with the pins in alignment with the holes in the bosses and pressing the parts together to engage the pins within the holes.

* * * * *